US009039959B2

(12) United States Patent
Maggioli et al.

(10) Patent No.: US 9,039,959 B2
(45) Date of Patent: May 26, 2015

(54) COOLING PLATE ARRANGEMENT AND METHOD FOR INSTALLING COOLING PLATES IN A METALLURGICAL FURNACE

(75) Inventors: Nicolas Maggioli, Thionville (FR); Paul Tockert, Berbourg (LU); Nicolas Mousel, Dudelange (LU); Claude Pleimelding, Platen (LU)

(73) Assignee: Paul Wurth S.A., Luxembourg (LU)

( * ) Notice: Subject to any disclaimer, the term of this patent is extended or adjusted under 35 U.S.C. 154(b) by 379 days.

(21) Appl. No.: 12/996,514

(22) PCT Filed: Jun. 5, 2009

(86) PCT No.: PCT/EP2009/056981
§ 371 (c)(1),
(2), (4) Date: Dec. 6, 2010

(87) PCT Pub. No.: WO2009/147251
PCT Pub. Date: Dec. 10, 2009

(65) Prior Publication Data

US 2011/0074071 A1 Mar. 31, 2011

(30) Foreign Application Priority Data

Jun. 6, 2008 (LU) ..... 91 455

(51) Int. Cl.
*F27D 1/12* (2006.01)
*F27D 1/14* (2006.01)
*F27D 1/16* (2006.01)

(52) U.S. Cl.
CPC *F27D 1/12* (2013.01); *F27D 1/145* (2013.01); *F27D 1/1678* (2013.01)

(58) Field of Classification Search
CPC ..... F27D 1/12; F27D 1/145; F27D 1/1678
USPC ..... 266/44, 194, 193, 241; 29/428, 890.03; 165/170; 122/6 A, 6 B
See application file for complete search history.

(56) References Cited

U.S. PATENT DOCUMENTS 4,389,041 A * 6/1983 Megerle ..... 266/194
5,678,806 A * 10/1997 Hille et al. ..... 266/193

(Continued)

FOREIGN PATENT DOCUMENTS

DE 2907511 C2 9/1980
EP 1260767 A1 11/2002

(Continued)

OTHER PUBLICATIONS

International Search Report PCT/EP2009/056981; Dated Jul. 28, 2009.

*Primary Examiner* — Scott Kastler
*Assistant Examiner* — Michael Aboagye
(74) *Attorney, Agent, or Firm* — Cantor Colburn LLP

(57) ABSTRACT

The present invention proposes a gap-filler insert (20) for use with cooling plates (12, 12') for a metallurgical furnace, the cooling plates (12, 12') having a front face (14, 14') directed towards the interior of the furnace, an opposite rear face (16, 16') directed towards a furnace wall (10) of the furnace and four edge faces (18, 18'). In accordance with an aspect of the present invention, the gap-filler insert (20) comprises a metal front plate (24) with a front side (24) facing the interior of the furnace and anchoring means (28, 28', 30, 30', 32, 34) for mounting the front plate (24) between two neighboring cooling plates (12, 12') in such a way that the front plate (24) extends between the edge faces (18, 18') of both cooling plates (12, 12'), and that the front side (26) of the front plate (24) is flush with the front faces (14, 14') of both cooling plates (12, 12').

19 Claims, 1 Drawing Sheet

(56) References Cited

U.S. PATENT DOCUMENTS

| | | | | | |
|---|---|---|---|---|---|
| 5,904,893 | A | * | 5/1999 | Stein | 266/46 |
| 6,132,673 | A | * | 10/2000 | Hille et al. | 266/193 |
| 6,682,300 | B2 | * | 1/2004 | Bolms | 415/173.3 |

FOREIGN PATENT DOCUMENTS

| | | | | | |
|---|---|---|---|---|---|
| FR | 2437447 | | * | 4/1980 | C21B 7/10 |
| JP | 11140519 | A | | 5/1999 | |
| JP | 2008121079 | A | | 5/2008 | |

* cited by examiner

COOLING PLATE ARRANGEMENT AND METHOD FOR INSTALLING COOLING PLATES IN A METALLURGICAL FURNACE

TECHNICAL FIELD

The present invention generally relates to a cooling plate arrangement in a metallurgical furnace. The present invention further relates to a method for installing a cooling plate arrangement in a metallurgical furnace.

BACKGROUND

Cooling plates for a metallurgical furnace, also called staves, are well known in the art. They are used to cover the inner wall of the outer shell of the metallurgical furnace, as e.g. a blast furnace or electric arc furnace, to provide: (1) a heat evacuating protection screen between the interior of the furnace and the outer furnace shell; and (2) an anchoring means for a refractory brick lining, a refractory guniting or a process generated accretion layer inside the furnace. Originally, the cooling plates have been cast iron plates with cooling pipes cast therein. As an alternative to cast iron staves, copper staves have been developed. Nowadays most cooling plates for a metallurgical furnace are made of copper, a copper alloy or, more recently, of steel.

A copper cooling plate for a blast furnace is e.g. disclosed in German patent DE 2907511 C2. It comprises a panel-like body having a hot face (i.e. the face facing the interior of the furnace) that is subdivided by parallel grooves into lamellar ribs. The grooves and ribs, which preferably have a dovetail (or swallowtail) cross-section and are arranged horizontally when the cooling plate is mounted on the furnace wall, to anchor a refractory brick lining, a refractory guniting material or a process generated accretion layer to the hot face of the cooling plate. Drilled cooling channels extend through the panel-like body in proximity of the rear face, i.e. the cold face of the cooling plate, perpendicularly to the horizontal grooves and ribs.

Such cooling plates are mounted in a plurality of rings against the furnace wall, wherein the rear faces of the cooling plates are directed towards the furnace wall. Because the furnace wall is generally rounded and the cooling plates are in principle planar, a space exists between the furnace walls and the cooling plates. This space is generally filled with backfilling concrete. Gaps are also present between the edge faces of neighboring cooling plates. These gaps are generally also filled with the backfilling concrete.

Generally, a refractory brick lining, a refractory guniting material or a process generated accretion layer is then provided against the front face of the cooling plate to form a protective layer. This protecting layer is useful in protecting the cooling plate from deterioration caused by the harsh environment reigning inside the furnace. At the same time, the protecting layer also protects the backfilling concrete in the gaps between cooling plates from deterioration. In practice, the furnace is however also occasionally operated without this protective layer, resulting first of all in the erosion of the backfilling concrete in the gaps. These gaps then contribute to a particularly uneven erosion of the cooling plates.

BRIEF SUMMARY

The invention provides a cooling plate arrangement wherein the cooling plates are protected from uneven erosion. The invention further provides a method for installing a cooling plate arrangement in a metallurgical furnace wherein the cooling plates are protected from uneven erosion.

The present invention proposes a cooling plate arrangement mounted on a furnace wall of a metallurgical furnace, the arrangement comprising a first cooling plate and a neighboring second cooling plate, each cooling plate having a front face directed towards the interior of said furnace, an opposite rear face directed towards said furnace wall and four edge faces. In accordance with an aspect of the present invention, a gap-filler insert is arranged between two neighboring cooling plates, the gap-filler insert comprising a metal front plate with a front side facing the interior of the furnace and anchoring means for mounting the front plate between two neighboring cooling plates in such a way that the front plate extends between the edge faces of both cooling plates, and that the front side of the front plate is flush with the front faces of both cooling plates.

By means of the gap-filler insert, the cooling plate arrangement according to the invention prevents deterioration of the backfilling concrete in the gaps between cooling plates. The transition from one cooling plate to another remains as smooth as possible even when, as is occasionally the case, the furnace is operated without protection layer (refractory brick lining, guniting or accretion layer) covering the cooling panels and the gaps therebetween. The gap-filler insert largely prevents backfilling concrete from being removed by the harsh conditions reigning in the furnace. Due to the gap-filler insert, an uneven erosion of the cooling plates can hence be avoided, thereby prolonging the lifetime of the cooling plates.

The front plate of the gap-filler insert may be made from steel, preferably high wear resistant steel. Examples of such high wear resistant steels are Creusabro® or Hardox®.

According to a first preferred embodiment, the anchoring means comprises two lateral legs, each lateral leg being connected to one edge of the front plate, which is in abutment with one edge face of one cooling plate, the lateral legs being arranged alongside a respective edge face of the cooling plates. The lateral legs may each comprise an extension shaped so as to be in abutment with the rear faces of the cooling plates.

Preferably, the front plate of the gap-filler insert and the lateral legs are formed in one piece from sheet metal so as to easily conform to the exact shape of the gap between the cooling plates. Alternatively, the lateral legs can be welded to the front plate of the gap-filler insert.

Generally, the furnace wall is rounded and the cooling plates are planar; a gap between two neighboring cooling plates may therefore be generally wedge shaped. Preferably, the lateral legs of the gap-filler insert are arranged at an angle so as to snuggly fit into the wedge shaped gap.

According to a second preferred embodiment, the anchoring means comprises at least one connecting arm connected to the front plate and to a rear plate, the rear plate being in abutment with the rear faces of the cooling plates.

Preferably, the front plate and the rear plate of the gap-filler insert are made from sheet metal and the connecting arm is welded to both the front and rear plates.

For maintaining the gap-filling insert in the correct position, the gap-filler insert may be connected to the cooling plates through form-fit or by the use of bolts or screws. Such bolts or screws may e.g. be fed through a hole in a lateral leg to connect the latter to a side face of the cooling plate, or the bolts or screws may be fed through a hole in a lateral leg extension or a rear plate to connect the latter to a rear face of the cooling plate. Another way of maintaining the gap-filler insert in the correct position, would be to fill a space between the cooling plates and the furnace wall with backfilling material, generally backfilling concrete.

According to an aspect of the invention, the gap-filler insert is arranged between vertical edges of neighboring cooling plates. The gap-filler insert may however also be arranged between horizontal edges of neighboring cooling plates. Generally, the cooling plates are arranged in a staggered configuration wherein a vertical gap between two neighboring cooling plates of an upper row is arranged in alignment of a central portion of a cooling plate of a lower row. The gap-filler insert arranged between horizontal edges of the cooling plates then preferably extends between two edges of the cooling plate of a lower row.

Preferably, the front plate of the gap-filler insert extends over the whole length of a gap between two neighboring cooling plates. It may, in some circumstances, however be preferable to provide shorter gap-filler inserts, wherein a plurality of such shorter gap-filler inserts may then be used to cover the whole length or only part of the length of a gap between two cooling plates.

Preferably, the cooling plate is made of at least one of the following materials: copper, a copper alloy or steel.

The present invention further proposes a method for installing cooling plates against a furnace wall of a metallurgical furnace. Such a method comprises providing a first cooling plate and a neighboring second cooling plate, each cooling plate having a front face directed towards the interior of the furnace, an opposite rear face directed towards the furnace wall and four edge faces. In accordance with an aspect of the present invention, the method further comprises providing a gap-filler insert comprising a metal front plate with a front side facing the interior of the furnace and anchoring means; and mounting the gap-filler insert between two neighboring cooling plates in such a way that the front plate extends between the edge faces of both cooling plates, and that the front side of the front plate is flush with the front faces of both cooling plates.

The gap-filler insert used in the present method is advantageously a gap-filler insert as described here-above.

BRIEF DESCRIPTION OF THE DRAWINGS

Preferred embodiments of the invention will now be described, by way of example, with reference to the accompanying drawings, in which.

DETAILED DESCRIPTION

Figure 1:
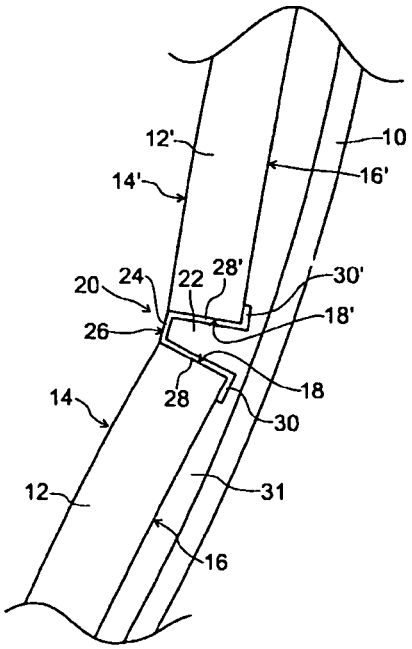
FIG. 1 is a schematic cross-sectional view across a wall portion of a furnace wall, wherein a cooling plate arrangement according to a first embodiment of the invention is shown.

Cooling plates are used to cover the inner wall of an outer shell of a metallurgical furnace, as e.g. a blast furnace or electric arc furnace. The cooling plates form: (1) a heat evacuating protection screen between the interior of the furnace and the outer furnace shell; and (2) an anchoring means for a refractory brick lining, a refractory guniting or a process generated accretion layer inside the furnace.

The Figures show a portion of such an inner wall 10 in a cross-section view as seen from above. In front of the inner wall 10, a cooling plate arrangement, comprising a plurality of cooling plates 12, 12', is installed. A first cooling plate 12 and a second cooling plate 12' are partially shown in the Figures. Each cooling plate 12, 12' has a panel-like body, which is e.g. made of a cast or forged body of copper, a copper alloy or steel. This panel-like body has a front face 14, 14', also referred to as hot face, which will be facing the interior of the furnace, and a rear face 16, 16', also referred to as cold face, which will be facing the inner surface of the inner wall 10. The panel-like body generally has the form of a quadrilateral with a pair of long edge faces, which are generally arranged vertically, and a pair of short edge faces, which are generally arranged horizontally. On the figures, only one of the long edge faces 18, 18' can be seen. Most modern cooling plates have a width in the range of 600 to 1300 mm and a height in the range of 1000 to 4200 mm. It will however be understood that the height and width of the cooling plate may be adapted, amongst others, to structural conditions of a metallurgical furnace and to constraints resulting from their fabrication process.

The cooling plates 12, 12' further comprise connection pipes (not shown) on the rear face 16, 16' for circulating a cooling fluid, generally water, through cooling channels (not shown) arranged within the cooling plates 12, 12'. The cooling plates 12, 12' are generally mounted to the inner wall 10 by means of brackets (not shown).

It will be noted that the front face 14, 14' is generally subdivided by means of grooves (not shown) into lamellar ribs (not shown). The grooves and lamellar ribs form anchorage means for anchoring a refractory brick lining, a refractory guniting or a process generated accretion layer to the front face 14.

According to the present invention, a gap-filler insert 20 is provided in a gap 22 between the first and second cooling plates 12, 12'.

A gap-filler insert 20 according to a first embodiment is shown in FIG. 1. This gap-filler insert 20 comprises a metal front plate 24 with a front side 26 facing the interior of the furnace. Such a front plate 24 is preferably made from high wear resistant steel, such as e.g. Creusabro® or Hardox®. The front plate 24 is arranged such that it extends between the long edge faces 18, 18' of both cooling plates 12, 12' and such that the front side 26 of the front plate 24 is flush with the front faces 14, 14' of both cooling plates 12, 12'. Due to such a front plate 24, the gap 22 between cooling plates 12, 12' is sealed off. Any backfilling concrete arranged in this gap 22 is protected from deterioration by the front plate 24. Even when the furnace is operated without protection layer (refractory brick lining, guniting or accretion layer), i.e. when the cooling plates 12, 12' are directly exposed to the harsh conditions reigning in the furnace, the transition from one cooling plate 12 to another 12' remains as smooth as possible. The front plate 24 prevents backfilling concrete from being removed and an uneven erosion of the cooling plates can hence be avoided.

In order to maintain the front plate 24 in its desired position, the gap-filler insert 20 further comprises anchoring means, which, in the case of the first embodiment, is composed of two lateral legs 28, 28'. Each lateral leg 28, 28' is connected to one edge of the front plate 24 and extends, along the long edge face 18' 18' to the rear face 16, 16' of the cooling plate 12, 12', where an extension 30, 30' of the lateral leg 28, 28' is formed so as to lie against the rear face 16, 16'.

The front plate 24 of the gap-filler insert 20 and the lateral legs 28, 28' with its extensions 30, 30' are formed in one piece from sheet metal so as to easily conform to the exact shape of the gap 22 between the cooling plates 12, 12'.

As the furnace wall 10 is generally rounded and the cooling plates are usually planar, a gap between two neighboring cooling plates 12, 12' is often wedge shaped. The lateral legs 28, 28' of the gap-filler insert 20 are arranged at an angle so as to snuggly fit into the wedge shaped gap 22, as shown in FIG. 1.

In order to ensure that the gap-filling insert 20 remains in the correct position, the gap-filler insert 20 may be connected to the cooling plates 12, 12' through form-fit or by the use of bolts or screws (not shown). Another way of maintaining the gap-filler insert 20 in the correct position is to fill a space 31 between the cooling plates 12, 12' and the furnace wall 10 with backfilling concrete. Backfilling concrete is then also poured into the gap 22 between the cooling plates 12, 12'. Due to the compactness of the backfilling concrete, the gap-filling insert 20 is prevented from moving in a direction towards the furnace wall 10. Further, as the extensions 30, 30' prevent the gap-filling insert 20 from moving in a direction away from the furnace wall 10, the gap-filling insert 20 is securely located in its desired location.

Figure 2:
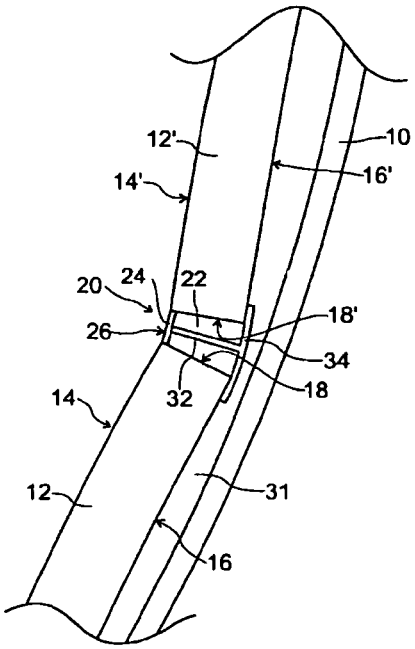
FIG. 2 is a schematic cross-sectional view across a wall portion of a furnace wall, wherein a cooling plate arrangement according to a second embodiment of the invention is shown.

A gap-filler insert 20 according to a second embodiment is shown in FIG. 2. This gap-filler insert 20 comprises a metal front plate 24 such as the one shown in FIG. 1. The anchoring means is, according to this second embodiment, composed of at least one connecting arm 32, which is with one end connected to a rear face of the front plate 24. The connecting arm 32 extends through the gap 22 to the rear of the cooling plates 12, 12', where it is connected to a rear plate 34. The rear plate 34 extends so as to be in abutment with the rear faces 16, 16' of the cooling plates 12, 12', thereby preventing any movement of the gap-filling insert 20 from moving in a direction away from the furnace wall 10. The front and rear plates 24, 34 are made from sheet material and the connecting arm 32 is welded therebetween.

The invention claimed is:

1. A cooling plate arrangement mounted on a furnace wall of a metallurgical furnace, said arrangement comprising:

a first cooling plate and a neighboring second cooling plate, each cooling plate having a front face directed towards an interior of said furnace, an opposite rear face directed towards said furnace wall and four edge faces;

a gap-filler insert arranged between two neighboring cooling plates, said gap-filler insert comprising a metal front plate with a front side facing the interior of said furnace and anchoring means for mounting the front plate between two neighboring cooling plates;

said gap-filler insert being arranged in such a way that said front plate extends between the edge faces of both cooling plates, and that said front side of said front plate is co-linear with said front faces of both cooling plates.

2. The cooling plate arrangement as claimed in claim 1, wherein said front plate of said gap-filler insert is made from steel.

3. The cooling plate arrangement as claimed in claim 2, wherein said front plate of said gap-filler insert is made from high wear resistant steel.

4. The cooling plate arrangement as claimed in claim 1, wherein said anchoring means comprises two lateral legs, each lateral leg being connected to one edge of said front plate, which is in abutment with one edge face of one cooling plate, said lateral legs being in arranged alongside a respective edge face of said cooling plates.

5. The cooling plate arrangement as claimed in claim 4, wherein said lateral legs each comprise an extension shaped so as to be in abutment with said rear faces of said cooling plates.

6. The cooling plate arrangement as claimed in claim 4, wherein said front plate of said gap-filler insert and said lateral legs are made from sheet metal.

7. The cooling plate arrangement as claimed in claim 4, wherein said gap-filler insert is formed in one piece.

8. The cooling plate arrangement as claimed in claim 4, wherein said lateral legs are welded to said front plate of said gap-filler insert.

9. The cooling plate arrangement as claimed in claim 4, wherein a gap between two neighboring cooling plates is wedge shaped and wherein said lateral legs of said gap-filler insert are arranged at an angle so as to snuggly fit into said wedge shaped gap.

10. The cooling plate arrangement as claimed in claim 1, wherein said anchoring means comprises at least one connecting arm connected to said front plate and to a rear plate, said rear plate being in abutment with said rear faces of said cooling plates.

11. The cooling plate arrangement as claimed in claim 10, wherein said front plate and said rear plate of said gap-filler insert are made from sheet metal and wherein said connecting arm is welded to both said front and rear plates.

12. The cooling plate arrangement as claimed in claim 1, wherein said gap-filler insert is connected to said cooling plates through form-fit and/or by mechanical means such as bolts or screws.

13. The cooling plate arrangement as claimed in claim 1, wherein said gap-filler insert is connected to said cooling plates by bolts or screws.

14. The cooling plate arrangement as claimed in claim 1, wherein said gap-filler insert is connected to said cooling plates by filling a space between cooling plates and furnace wall with backfilling material.

15. The cooling plate arrangement as claimed in claim 1, wherein said gap-filler insert is arranged between vertical edges and/or horizontal edges of neighboring cooling plates.

16. The cooling plate arrangement as claimed in claim 1, wherein said gap-filler insert is arranged between horizontal edges of neighboring cooling plates.

17. The cooling plate arrangement as claimed in claim 16, wherein said cooling plates are arranged in a staggered configuration wherein a vertical gap between two neighboring cooling plates of an upper row is arranged in alignment of a central portion of a cooling plate of a lower row, and wherein said gap-filler insert arranged between horizontal edges of said cooling plates extends between two edges of said cooling plate of a lower row.

18. The cooling plate arrangement as claimed in claim 1, wherein said front plate extends over the whole length of a gap between two neighboring cooling plates.

19. The cooling plate arrangement as claimed in claim 1, wherein said cooling plate is made of at least one of the following materials: copper, a copper alloy or steel.

* * * * *